US010888748B2

(12) United States Patent
Stites et al.

(10) Patent No.: US 10,888,748 B2
(45) **Date of Patent: *Jan. 12, 2021**

(54) GOLF CLUB AND GOLF CLUB HEAD WITH A SOLE CAVITY FEATURE

(71) Applicant: KARSTEN MANUFACTURING CORPORATION, Phoenix, AZ (US)

(72) Inventors: John T. Stites, Sallisaw, OK (US); Robert Boyd, Double Oak, TX (US); Raymond J. Sander, Benbrook, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/687,452

(22) Filed: Nov. 18, 2019

(65) Prior Publication Data

US 2020/0078645 A1 Mar. 12, 2020

Related U.S. Application Data

(63) Continuation of application No. 16/176,124, filed on Oct. 31, 2018, now Pat. No. 10,493,334, which is a (Continued)

(51) Int. Cl.
*A63B 53/04* (2015.01)

(52) U.S. Cl.
CPC ..... *A63B 53/0466* (2013.01); *A63B 53/04* (2013.01); *A63B 53/045* (2020.08); (Continued)

(58) Field of Classification Search
CPC ..... A63B 2053/0433; A63B 2053/045; A63B 2053/0408; A63B 53/0466; A63B 53/04 (Continued)

(56) References Cited

U.S. PATENT DOCUMENTS 3,166,320 A 1/1965 Onions
3,810,631 A 5/1974 Braly
(Continued)

FOREIGN PATENT DOCUMENTS

EP 0619125 10/1994
JP S51098847 8/1976
(Continued)

OTHER PUBLICATIONS

International Search Report and Written Opinion dated Aug. 27, 2013 for PCT Application No. PCT/US2013/043258, filed May 30, 2013.

*Primary Examiner* — Benjamin Layno

(57) ABSTRACT

A golf club includes a shaft and a club head for a metal wood type club head. The club head includes a ball striking face, a heel, a toe, a rear, a crown, and a sole. The sole includes a forward sole surface and a rearward sole surface. The substantially horizontally-oriented forward sole surface extends rearwardly from the ball striking face to a rearward edge. The substantially horizontally-oriented rearward sole surface extends forwardly from the rear of the club head. The rearward sole surface extends over and is offset in a height direction from the rearward edge. A cavity may be located above the forward sole surface, the cavity having a rearward facing opening located below the rearward sole surface. A projection may extend rearwardly from the rearward edge beneath the rearward sole surface, the projection having sides that extend in a generally breadthwise direction.

20 Claims, 7 Drawing Sheets

Related U.S. Application Data continuation of application No. 15/414,915, filed on Jan. 25, 2017, now Pat. No. 10,155,139, which is a continuation of application No. 14/684,912, filed on Apr. 13, 2015, now Pat. No. 9,586,102, which is a continuation of application No. 13/905,745, filed on May 30, 2013, now Pat. No. 9,028,342.

(60) Provisional application No. 61/654,040, filed on May 31, 2012.

(52) U.S. Cl.
CPC ..... *A63B 53/0408* (2020.08); *A63B 53/0412* (2020.08); *A63B 53/0433* (2020.08)

(58) Field of Classification Search
USPC ..... 473/344, 328, 350, 345, 346

See application file for complete search history.

(56) References Cited

U.S. PATENT DOCUMENTS

| | | | | |
|---|---|---|---|---|
| 4,444,392 | A | 4/1984 | Duclos | |
| 4,984,799 | A | 1/1991 | Finney | |
| 5,888,148 | A | 3/1999 | Allen | |
| 5,941,782 | A | 8/1999 | Cook | |
| 6,440,009 | B1 * | 8/2002 | Guibaud ..... | A63B 53/04 473/334 |
| 9,586,102 | B2 | 3/2017 | Stites | |
| 10,155,139 | B2 | 12/2018 | Stites | |
| 10,493,334 | B2 * | 12/2019 | Stites ..... | A63B 53/0466 |
| 2002/0006833 | A1 | 1/2002 | Mason | |
| 2008/0194354 | A1 | 8/2008 | Nagai et al. | |
| 2010/0323811 | A1 | 12/2010 | Mickelson et al. | |
| 2012/0178548 | A1 | 7/2012 | Tavares et al. | |

FOREIGN PATENT DOCUMENTS

| | | |
|---|---|---|
| JP | S60129969 | 8/1985 |
| JP | H10-500875 | 1/1998 |
| JP | 2000157651 | 6/2000 |
| JP | 2006297117 | 11/2006 |

* cited by examiner

GOLF CLUB AND GOLF CLUB HEAD WITH A SOLE CAVITY FEATURE

RELATED APPLICATIONS

This is a continuation of U.S. patent application Ser. No. 16/176,124, filed Oct. 31, 2018, now U.S. Pat. No. 10,493,334, which is a continuation of U.S. patent application Ser. No. 15/414,915, filed Jan. 25, 2017, now U.S. Pat. No. 10,155,139, which is a continuation of U.S. patent application Ser. No. 14/684,912, now U.S. Pat. No. 9,586,102, filed Apr. 13, 2015, which is continuation of U.S. patent application Ser. No. 13/905,745, now U.S. Pat. No. 9,028,342, filed May 30, 2013, now U.S. Pat. No. 9,028,342, which claims the benefit of and priority to U.S. Provisional Application No. 61/654,040, filed May 31, 2012, wherein the contents of all above-described disclosures are incorporated herein by reference in their entirely.

FIELD

Aspects of this invention relate generally to golf clubs and golf club heads, and, in particular, to golf clubs and golf club heads having a portion of the club head removed, thereby creating a void in the club head, in order to reduce weight associated with the club head and enhance performance.

BACKGROUND

Golfers tend to be sensitive to the "feel" of a golf club. The "feel" of a golf club comprises the combination of various component parts of the club and various features associated with the club that produce the sensations experienced by the player when a ball is swung at and/or struck. Club weight, weight distribution, swing weight, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, lose his/her grip, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

The performance of a golf club can vary based on several factors, including weight distribution about the head, which affects the location of the center of gravity of the golf club head. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, including ball flights that often are referred to as "pulls," "pushes," "draws," "fades," "hooks," or "slices." Similarly, when the center of gravity is spaced above or below the point of engagement, the flight of the golf ball may exhibit more boring or climbing trajectories, respectively.

Altering the moment of inertia can also affect how the golf club performs including how the golf club head design impacts heel and toe mishits. Similarly, other factors such as point of impact and launch angle can also affect how the ball travels once it has been struck.

Club designers are often looking for new ways to redistribute weight associated with a golf club and/or golf club head. For instance, club designers are often looking to distribute weight to provide more forgiveness in a club head, improved accuracy, and the like.

It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

At least some aspects of the disclosure relate to golf clubs and golf club heads having a void, channel, or other recessed feature formed in the sole of the golf club head.

In accordance with certain aspects, a golf club includes a shaft and a club head secured to a distal end of the shaft. A golf club head for a metal wood type club may include a ball striking face, a heel, a toe, a rear, a crown and a sole. The club head may define a top-to-bottom height, a front-to-back breadth, and a side-to-side length. The sole may include a substantially horizontally-oriented forward sole surface extending rearwardly from the ball striking face to a rearward edge. The sole may also include a substantially horizontally-oriented rearward sole surface extending forwardly from the rear of the club head. The rearward sole surface may extend over the rearward edge of the forward sole surface and be offset from the rearward edge in a height direction. A cavity may be located above the forward sole surface. The cavity may have a rearward facing opening located below the rearward sole surface.

According to other aspects, a sole for a golf club head for a metal wood type club may include a substantially horizontally-oriented forward sole surface extending rearwardly from the ball striking face to a rearward edge and a substantially horizontally-oriented rearward sole surface extending forwardly from the rear of the club head. The rearward edge of the forward sole surface may extend in a generally lengthwise direction. The rearward sole surface may be offset from the rearward edge in a height direction. A projection may extend rearwardly from the rearward edge beneath the rearward sole surface. The projection may have side edges that extend in a generally breadthwise direction.

These and additional features and advantages disclosed here will be further understood from the following detailed disclosure of certain embodiments.

Figure 1B:
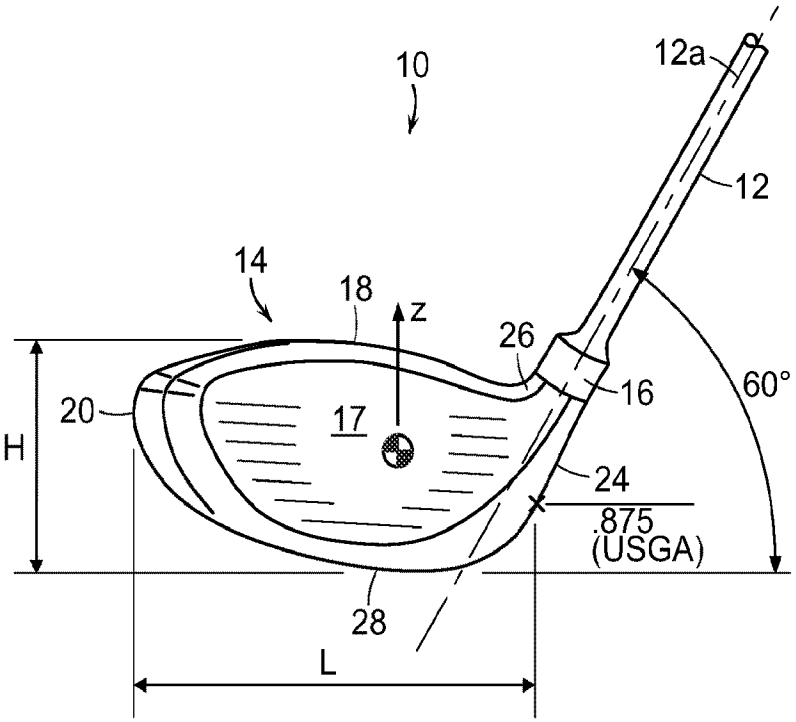
FIG. 1B is a schematic front view of a golf club illustrating certain parameters.

The figures referred to above are not drawn necessarily to scale, should be understood to provide a representation of particular embodiments of the invention, and are merely conceptual in nature and illustrative of the principles involved. Some features of the golf club head depicted in the drawings may have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

In the following description of various example structures in accordance with the invention, reference is made to the accompanying drawings, which form a part hereof, and in which are shown by way of illustration various example articles, including one or more golf club or golf club head structures. Additionally, it is to be understood that other specific arrangements of parts and structures may be utilized and structural and functional modifications may be made without departing from the scope of the present invention.

The invention generally will be described as it relates to wood-type golf clubs. However, aspects of the invention may be used with any of several types of golf clubs, including hybrid type golf clubs, utility clubs, and the like and nothing in the specification or figures should be construed to limit the invention to use with the wood-type golf clubs described. Thus, a wide variety of overall club head constructions are possible without departing from this invention.

Further, if desired, some or all of the various individual parts of the club heads described below may be made from multiple pieces that are connected together (e.g., by welding, adhesives, or other fusing techniques; by mechanical connectors; etc.). The various parts (e.g., crown, sole, ball striking face, rear, etc.) may be made from any desired materials and combinations of different materials, including materials that are conventionally known and used in the art, such as metal materials, including lightweight metal materials, and the like. More specific examples of suitable lightweight metal materials include steel, titanium and titanium alloys, aluminum and aluminum alloys, magnesium and magnesium alloys, etc. The various parts of the club head may be formed of one or more composite materials. The club head also may be made by forging, casting, or other desired processes, including club head forming processes as are conventionally known and used in the art.

The various individual parts that make up a club head structure, if made from multiple pieces, may be engaged with one another and/or held together in any suitable or desired manner, including in conventional manners known and used in the art. For example, the various parts of the club head structure, such as the ball striking face, the crown, the sole, etc., may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure together.

The dimensions and/or other characteristics of a golf club head structure according to examples of this invention may vary significantly without departing from the invention, and the dimensions may be consistent with those commonly used in the art for similar club heads and clubs.

Figure 1A:
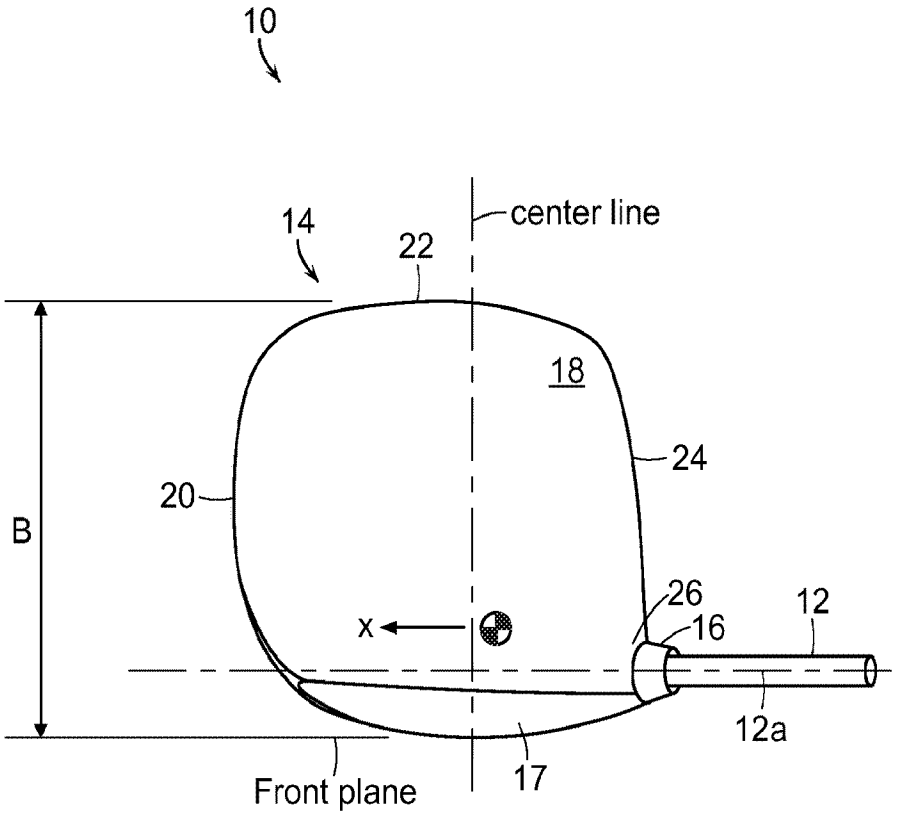
FIG. 1A is a schematic top plan view of a golf club illustrating certain parameters.

For purposes of this disclosure, and referring to FIGS. 1A and 1B, with a club head positioned at a 60-degree lie angle as defined by the USGA (see USGA, "Procedure for Measuring the Club Head Size of Wood Clubs"), the "centerline" of the club head may be considered to coincide with the indicator on the face squaring gauge when the face squaring gauge reads zero for clubs having a neutral face angle. The length (L) of the club head extends from the outermost point of the toe to the outermost point of the heel, as defined by the above-referenced USGA procedure. The breadth (B) of the club head extends from the outermost point of the face to the outermost point of the rear. Similar to the procedure for determining the outermost point of the toe (but now turned 90 degrees), the outermost points of the face and rear may be defined as the points of contact between the club head in the USGA 60-degree lie angle position with a vertical plate running parallel to the longitudinal axis of the shaft. The vertical plane associated with this measurement of the outermost point of the face may be referred to as the "front plane" of the club head. The height (H) of the club head extends from the lowermost point of the sole to the uppermost point of the crown, as defined by the above-referenced USGA procedure. The terms "above," "over," "below," "beneath," "upper," "lower," "top," "bottom," "front," "back," "rear," "side," "heel-side," "toe-side," etc. all may refer to views associated with the club head when it is positioned at this USGA 60-degree lie angle (also referred to as "a standard address position").

For purposes of this disclosure, "length" measurements or dimensions are taken parallel to the front plane of the club head and parallel to the ground. "Breadth" measurements or dimensions are taken parallel to the centerline of the club head and parallel to the ground. "Height" measurements or dimensions are taken parallel to a vertical plane when the club head is in its 60-degree lie angle position. Dimensions or measurements for a given region or surface are usually defined between transition points unless otherwise noted. A transition point is where a surface or region transitions from a generally (or substantially) vertical to a generally (or substantially) horizontal orientation or from a generally (or substantially) lengthwise to a generally (or substantially) breadthwise orientation. In the absence of a corner, a transition point may generally be defined as having a tangent at a 45 degree angle from the horizontal (or vertical) or a tangent at a 45 degree angle from the front plane (or centerline).

Still referring to FIGS. 1A and 1B, a golf club 10 having a golf club head 14 attached to a shaft 12 is shown schematically in order to illustrate certain general features. The golf club head 14 may be a driver, as shown. Club head 14 has a body that includes a hosel or socket 16 configured for receiving the shaft 12. The body of club head 14 may include a plurality of portions, regions or surfaces, such as a ball striking face 17, a crown 18, a toe 20, a rear 22, a heel 24, a hosel region 26 and a sole 28. For certain club heads, the body may include one or more cavities and/or may be substantially hollow.

Ball striking face 17 may be essentially flat or it may have a slight curvature or bow (for example, a "bulge" and/or a "roll"). Although the golf ball may contact ball striking face 17 at any spot on the face, the desired-point-of-contact of ball striking face 17 with the golf ball is typically approximately centered within ball striking face 17.

Crown 18, which is located on the upper or top side of club head 14, extends from ball striking face 17 back toward rear 22 of golf club head 14. When club head 14 is viewed from below, crown 18 cannot be seen.

Sole 28, which is located on the lower or ground side of club head 14 opposite to crown 18, extends from ball striking face 17 back toward rear 22. As with crown 18, sole 28 extends across the width of club head 14, from heel 24 to toe 20. When club head 14 is viewed from above, sole 28 cannot be seen.

Rear 22 is positioned opposite ball striking face 17, is located between crown 18 and sole 28, and extends from heel 24 to toe 20. When club head 14 is viewed from the front, rear 22 cannot be seen.

Heel 24 extends from ball striking face 17 to rear 22. When club head 14 is viewed from the toe-side, heel 24 cannot be seen.

Toe 20 is shown as extending from ball striking face 17 to rear 22 on the side of club head 14 opposite to heel 24. When club head 14 is viewed from the heel-side, toe 20 cannot be seen.

Socket 16 for attaching shaft 12 to club head 14 is located within hosel region 26. Hosel region 26 is shown as being located at the intersection of ball striking face 17, heel 24 and crown 18 and may encompass those portions of face 17, heel 24 and crown 18 that lie adjacent to socket 16. Generally, hosel region 26 includes surfaces that provide a smooth merging from socket 16 to ball striking face 17, heel 24, crown 18 and/or sole 28.

Club head 14 may have a generally squared profile along a rear perimeter, when viewed from above, such that it could be described as a "square head." Although not a true square in geometric terms, the rear perimeter profile would be considered substantially square as compared to a more traditional, rounded, club head. It is further to be appreciated by persons of ordinary skill in the art that club head 14 may be provided with a more traditional rounded shape, when viewed from above. The phrase "round head" refers a club head 14 having a generally or substantially rounded profile. Similarly, a club head 14 provided with a generally triangular shaped or more centrally pointed rear perimeter profile may be referred to as having a "triangular head."

A longitudinal axis or shaft axis 12*a* extending longitudinally down the center of shaft 12 is shown in FIG. 1B. A grip or other handle element (not shown) may be positioned on shaft 12 to provide a golfer with a slip resistant surface with which to grasp golf club shaft 12. Shaft 12 of golf club 10 may be made of various materials that are conventionally known and used in the art and may be attached to club head 14 in any desired manner.

Figure 2B:
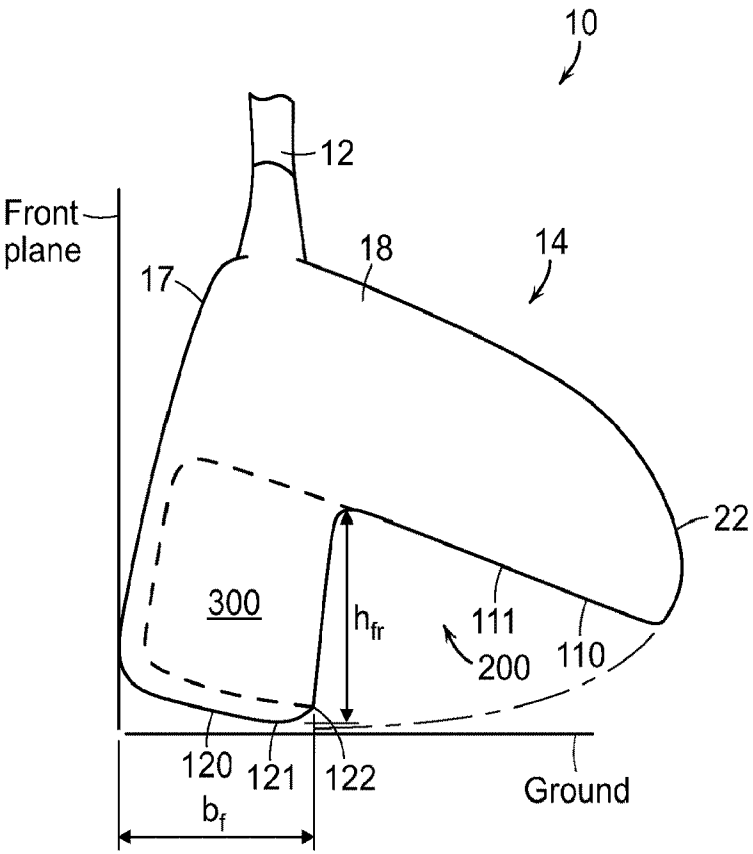
FIG. 2B is a heel-side view of the golf club of FIG. 2A.
Figure 2A:
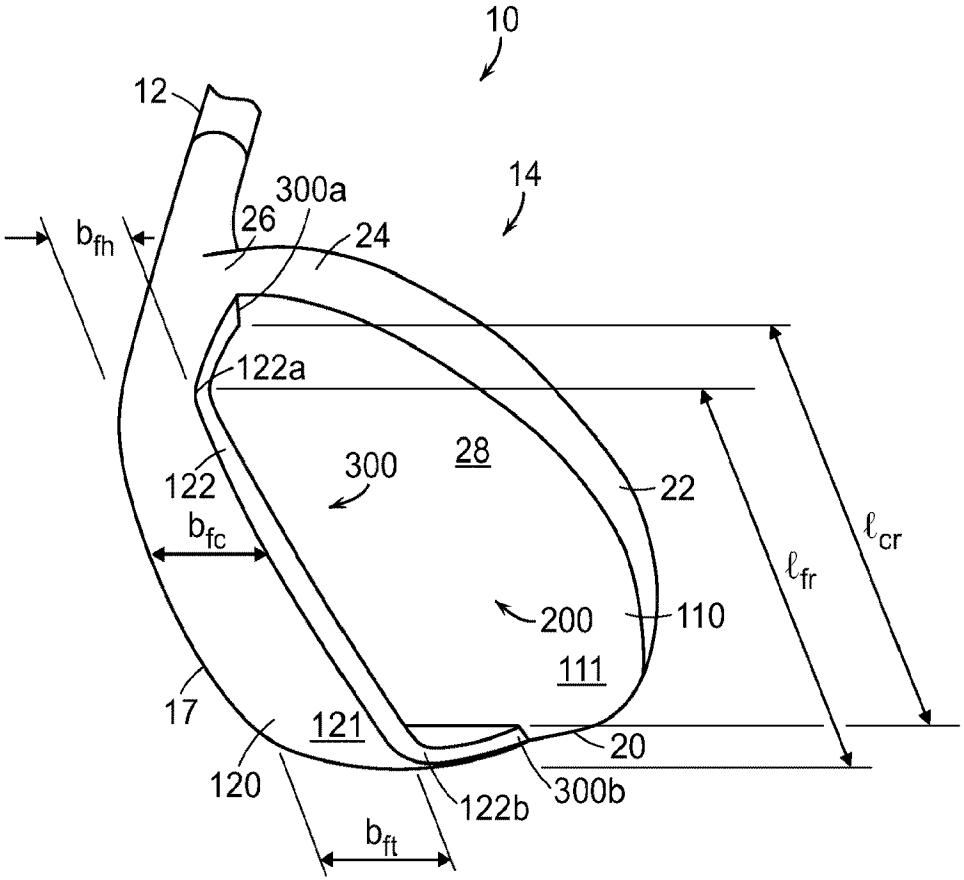
FIG. 2A is a perspective view, generally taken from a heel-side of the sole, of a golf club according to certain aspects.

Thus, club head 14 includes a ball striking face 17, a heel 24, a toe 20, a rear 20, a crown 18 and a sole 28. Further, club head 14 has a top-to-bottom height (H), a front-to-back breadth (B) and a side-to-side length (L). An illustrative embodiment of a metal wood type golf club according to aspects of the invention is shown in FIGS. 2A and 2B. As can generally be seen, sole 28 extends from ball striking face 17 toward rear 22 and from heel 24 to toe 20 of club head 14. According to certain aspects, sole 28 includes forward sole region 120 which is located adjacent ball striking face 17. Forward sole region 120 extends rearwardly from ball striking face 17 to a rearward edge 122. Further, forward sole region 120 extends from hosel region 26 and/or heel 24 to toe 20. Generally, forward sole region 120 has a downward facing, relatively (or substantially) horizontally-oriented, forward sole surface 121. This surface 121 may have a shallow curvature, typically, a gently-convex or gently-complex curvature, i.e., incorporating more than one of a concave, convex and/or planar feature.

Similarly, according to certain aspects, sole 28 includes a rearward sole region 110, which extends forwardly from rear 22. Rearward sole region 110 extends lengthwise from heel 24 to toe 20. Generally, rearward sole region 110 has a downward facing, relatively (or substantially) horizontally-oriented, rearward sole surface 111. Further, rearward sole region 110 may extend over (when the club is oriented in its standard address position) rearward edge 122 of forward sole region 121 and be offset from rearward edge 122 in a height (H) direction. Surface 111 may have a convex, concave or complex curvature. According to certain embodiments, rearward sole surface 111 may have planar features or even may be substantially planar.

As shown in FIGS. 2A and 2B, the elevation, or height, of forward sole region 120 differs from the elevation, or height, of rearward sole region 110. This difference in elevation may be referred to as a reduced-profile feature 200, in that, when viewed from the heel or the toe side, the profile of club head 14 is reduced as it extends from ball striking surface 17 toward rear 22. (In FIG. 2B, a dot-dash line shows a club head profile as it could be in the absence of the reduced-profile feature 200.) The reduced-profile feature 200 may reduce the mass of the club head 14 and raise the center of gravity of club head 14. For golfers with relatively slow swing speeds, raising the center of gravity may be advantageous. Specifically, raising the center of gravity may promote backspin, which, when coupled with a relatively slow swing speed, may promote beneficial lift and longer flight time of the golf ball. Further, reduced-profile feature 200 may essentially reduce the cross-sectional area of club head 14, when viewed from the heel-side, such that it is expected that air flowing over club head 14 from heel 24 toward toe 20 will encounter less resistance. Thus, it is expected that reduced-profile feature 200 may result in reduced drag over the course of the golfer's downswing, higher club head speed at the moment of impact with the golf ball, and increased travel distance of the golf ball.

According to certain aspects, rearward sole surface 111 may be located within a lower 60% of the height (H) of club head 14. In other words, downward-facing surface 111 may be located at a height of from 0% to 60% of the height (H) from the ground surface. Optionally, surface 111 may be located at a height of from 0% to 50% of the height (H), from 0% to 40% of the height (H), or even from 0% to 30% of the height (H). Alternatively, downward-facing rearward sole surface 111 may be located at a height of from 10% to 50% of the height (H), from 10% to 40% of the height (H), or even from 20% to 50% of the height (H).

Referring to FIGS. 2A and 2B, forward sole region 120 has height, length and breadth dimensions. Height and length dimensions are measured parallel to the front plane; breadth dimensions are measured perpendicular to the front plane. Referring to FIG. 2B, a height dimension ($h_f$) of forward sole region 120 may be measured from the sole surface 111 of rearward sole region 110 to the sole surface 121 of forward sole region 120. One particularly relevant height dimension of forward sole region 120 may be the height dimension ($h_{fr}$) as measure at rearward edge 122. The height dimension ($h_f$) of forward sole region 120 may vary due to curvature in the surface 111 of rearward sole region 110 and/or due to curvature in the surface 121 of forward sole region 120. Referring to FIG. 2A, a length dimension ($l_f$) of forward sole region 120 and/or forward sole surface 121 may be measured from the heel 24 of club head 14 to the toe 20 of club head 14. The length dimension ($l_f$) of forward sole region 120 may vary along its breadth and along is height. One particularly relevant length dimension of forward sole region 120 may be the length dimension ($l_{fr}$) as measured at rearward edge 122. This rearward-most length dimension of forward sole region 120 may be measured from the heel-side end 122*a* to the toe-side end 122*b* of rearward edge 122. Referring to FIGS. 2A and 2B, a breadth dimension ($b_f$) of forward sole region 120 and/or forward sole surface 121 may be measured from the ball striking surface 17 of club head 14 to rearward edge 122 of forward sole region 120. The breadth dimension ($b_f$) of forward sole region 120 may vary along its length due to curvature in the surface of ball striking surface 17 and/or due to curvature in the rearward edge 122 of forward sole region 120. Forward sole region 120 may include a heel-side breadth dimension ($b_{fh}$), a central breadth dimension ($b_{fc}$) and a toe-side breadth dimension ($b_{ft}$).

According to certain embodiments, forward sole region 120 and/or forward sole surface 121 may have a heel-side breadth dimension (NO of 20 mm or greater. Alternatively, forward sole region 120 may have a heel-side breadth dimension ($b_{fh}$) of 25 mm or greater, of 30 mm or greater, of 35 mm or greater, or even of 40 mm or greater. Forward sole region 120 may have similar toe-side breadth dimensions ($b_{ft}$). Alternatively, the toe-side breadth dimension ($b_{ft}$) may be greater than the heel-side breadth dimension ($b_{fh}$).

According to some embodiments, forward sole region 120 may have a maximum height dimension ($h_f$) of 10 mm or greater. Alternatively, forward sole region 120 may have a maximum height dimension ($h_f$) of 20 mm or greater, a maximum height dimension ($h_f$) of 25 mm or greater, or even a maximum height dimension ($h_f$) of 30 mm or greater. Optionally, the difference in height between the forward sole surface 121 and the rearward sole surface 111 may range from 10 mm to 20 mm, from 10 mm to 30 mm, from 10 mm to 40 mm, or even from 15 mm to 25 mm. The maximum height dimension ($h_f$) of forward sole region 120 typically may be positioned closer to the centerline of club head 14 than to the heel- or toe-side.

Rearward edge 122 of forward sole region 120 and/or forward sole surface 121 may extend substantially linearly from heel-side to toe-side of club head 14. Rearward edge 122 may be oriented approximately parallel to the front plane or it may be angled from the front plane. The orientation of rearward edge 122 may be measured using a line connecting the heel-side end 122*a* with the toe-side end 122*b* of edge 122. In a positive orientation, rearward edge 122 is angle toward the rear 22 as it extends from the heel 24 toward the toe 20. As one example, rearward edge 122 may have an orientation that ranges from approximately O degrees to approximately 30 degrees from the front plane. Optionally, rearward edge 122 may have an orientation that is slightly negative, i.e., from approximately −10 degrees to approximately 0 degrees. As another example, rearward edge 122 may have an orientation that is greater than 30 degrees.

According to other aspects, rearward edge 122 may be slightly curved (convexly, concavely, or complexly) along its length, when viewed from below, as it extends from one side to the other of club head 14. For example, the profile of rearward edge 122, when viewed from above, may have a shallow convex curvature. The breadth dimension ($b_f$) of forward sole region 120 for such a slightly curved profile may vary by no more than 5% to 20%. For example, the ratio of the central breadth dimension ($b_{fc}$) to the heel-side breadth dimension ($b_{fh}$) may range from approximately 1.05 to approximately 1.20.

According to certain other aspects and referring to FIG. 3A, rearward edge 122 may have a more exaggerated curvature (convex, concave, or complex) extending from the heel-side to the toe-side, when viewed from below. When provided with a deeper curvature, the breadth dimension of forward sole region 120 may vary by greater than 20%, greater than 30%, greater than 40%, or even greater than 50%. For example, the ratio of a central breadth dimension ($b_{fc}$) of forward sole region 120 to the heel side breadth dimension ($b_{fh}$) may range from greater than approximately 1.20, greater than approximately 1.30, greater than approximately 1.40 or even greater than approximately 1.50.

Figure 3B:
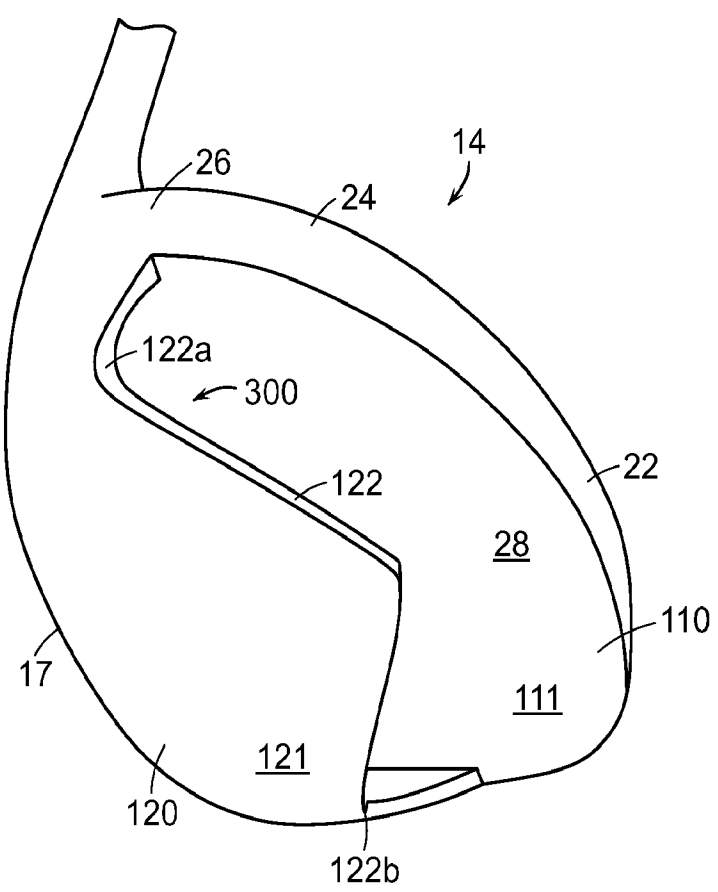
FIG. 3B is a perspective view, generally taken from a heel-side of the sole, of a golf club according to certain aspects.
Figure 3A:
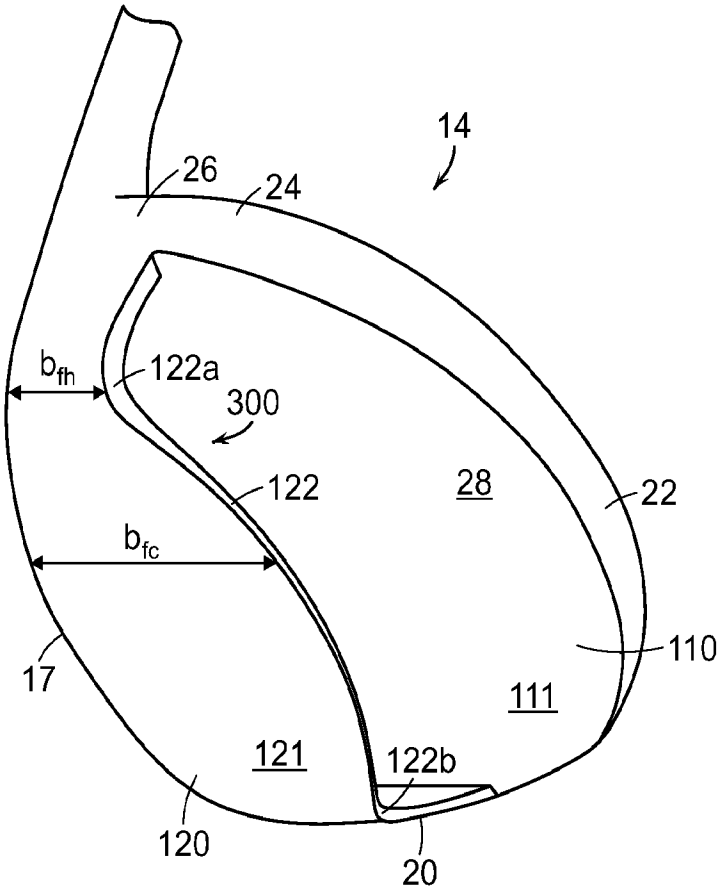
FIG. 3A is a perspective view, generally taken from a heel-side of the sole, of a golf club according to certain aspects.

In certain embodiments, for example, as shown in FIG. 3A, rearward edge 122 of forward sole region 120 may have a convex profile resembling a smoothly curved visor (i.e., a C-shaped profile), when viewed from below. Such a C-shaped profile may have a maximum breadth dimension generally positioned towards the center. Although, the heel-side and toe-side breadth dimensions may be approximately equal, in general, they need not be. When the heel-side and toe-side breadth dimensions are not approximately equal, the C-shaped profile, when viewed from below, may appear to be angled from the front plane.

In certain other embodiments, for example as shown in FIG. 3B, rearward edge 122 of forward sole region 120 may be somewhat pointed in a central region, resembling a chevron extending from the heel-side to the toe-side of the rearward edge 122 (i.e., a V-shaped or triangular-shaped profile), when viewed from below. The legs of the chevron may be straight or may be slightly curved. The point of the chevron may generally be located approximately on the centerline of the club head. Further, the point of the chevron may typically be somewhat rounded (as opposed to being sharply pointed). Again, the heel-side and toe-side breadth dimensions (NI, $b_{ft}$) may be approximately equal. When the heel-side and toe-side breadth dimensions are not approximately equal, the V-shaped profile may appear to be angled from the front plane.

Figure 4B:
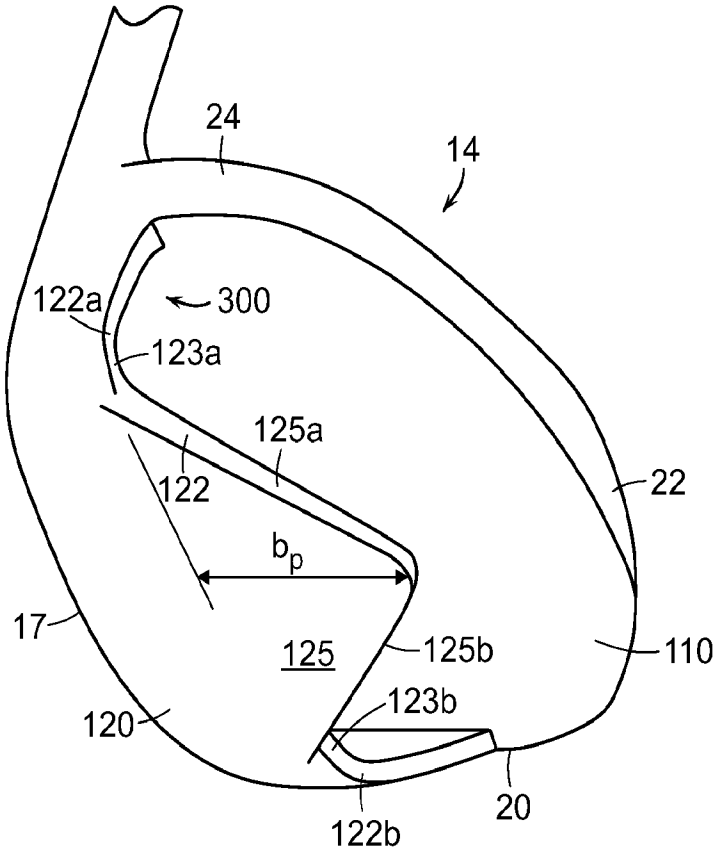
FIG. 4B is a perspective view, generally taken from a heel-side of the sole, of a golf club according to certain aspects.
Figure 4A:
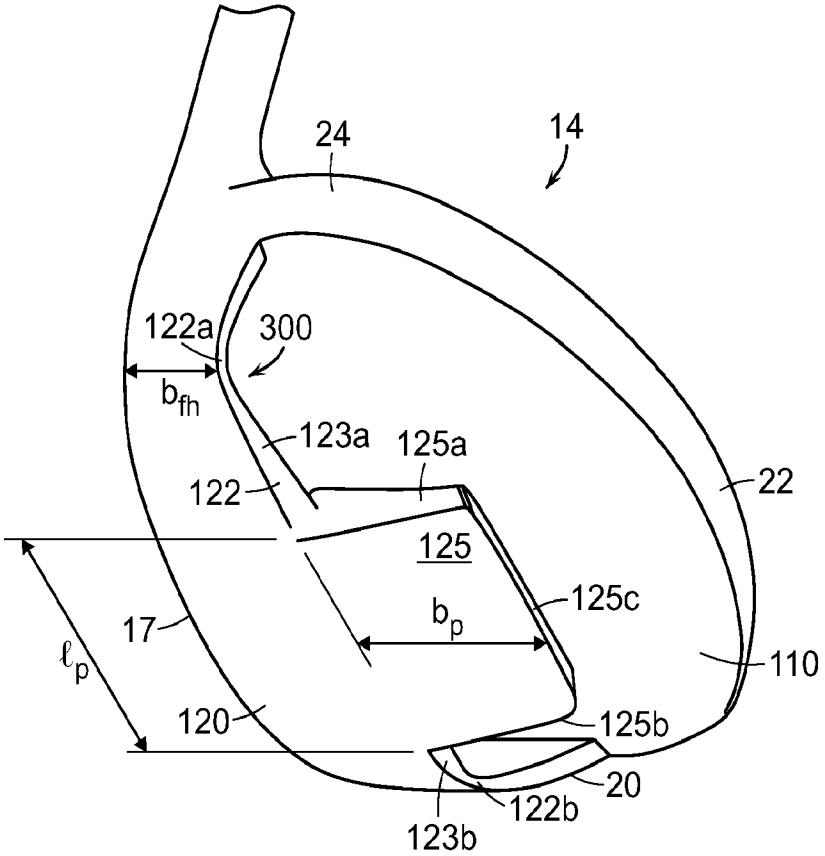
FIG. 4A is a perspective view, generally taken from a heel-side of the sole, of a golf club according to certain aspects.
Figure 4C:
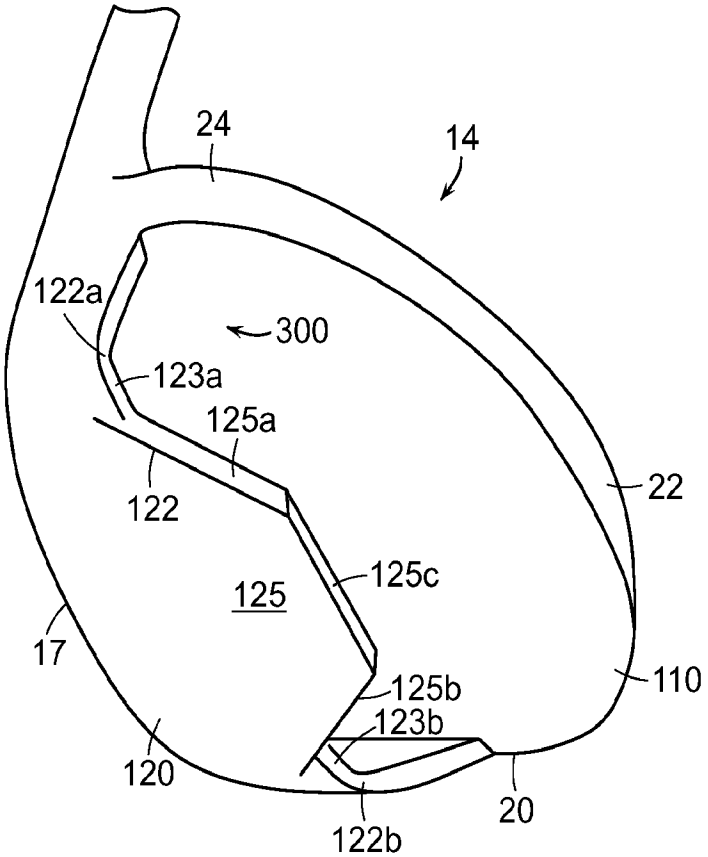
FIG. 4C is a perspective view, generally taken from a heel-side of the sole, of a golf club according to certain aspects.

According to certain aspects and referring now to FIGS. 4A-4C, forward sole region 120 may include a rearwardly-projecting portion (i.e., a rearward projection) 125. Rearward projection 125 may be a relatively flat, plate-like projection that extends rearwardly from rearward edge 122. Rearward projection 125 may extend rearwardly from rearward edge 122 beneath (when the club is oriented in its standard address position) rearward sole surface 110. Further, projection 125 may have a substantially planar surface. In certain embodiments, rearward projection 125 may be cantilevered. The rearmost end of a cantilevered rearward projection 125 is not supported. In certain other embodiments, rearward projection 125 may be at least partially supported. In general, the rearmost end of rearward projection 125 is not joined to the rear 22 of club head 14.

Example profiles, when viewed from above, of rearward projection 125 include a rectangular tang shown in FIG. 4A, a triangular tang shown in FIG. 4B, and a truncated-pyramidal tang shown in FIG. 4C. It is to be understood, that the profile of a rearward projection 125 need not be exactly rectangular (or triangular, pyramidal, etc.), but may be generally rectangular and still be described as being rectangular, etc. Rearward projection 125 may generally be centrally located (side-to-side). However, it is to be understood, that rearward projection 125 need not be exactly centrally located (i.e., symmetric with respect to the centerline), but may be generally located within a central region (relative to the heel and toe-sides of club head 14) and still be described as being centrally located. For purposes of this disclosure, a rearward projection 125 centered within plus or minus 20% of the length of club head 14 to the centerline of club head 14 may be considered centrally located. Other profiles for rearward projections, whether regularly-shaped, symmetric, non-symmetric, complexly-curved, etc. would be apparent to persons of ordinary skill in the arts, given the benefit of this disclosure.

In general, a rearward projection 125 may be defined as a portion of forward sole region 120 that extends rearwardly, relatively abruptly, from the adjacent portions of forward sole region 120. Thus, rearward edge 122 may have one or more segments that extend in a generally lengthwise direction (i.e., heel-to-toe) and one or more segments that extend in a generally breadthwise direction (i.e., front-to-back). Thus, as shown in FIGS. 4A-4C, rearward edge 122 may have a heel-side edge segment 123*a* and a toe-side edge segment 123*b* that extend substantially in a heel-to-toe, lengthwise, direction. In this embodiment, rearward edge 122 also may have a first generally rearwardly projecting edge segment 125*a* and a second generally rearwardly projecting edge segment 125*b* that extend substantially in a front-to-back, breadthwise, direction. The rearwardly projecting edge segments 125*a*, 125*b* define the sides of rearward projection 125. Depending upon the shape of the rearward projection 125, an end edge segment 125*c*, which defines the profile of the rearward end of rearward projection 125, may extend between the first projecting edge segment 125*a* and the second projecting edge segment 125*b* (see FIGS. 4A and 4C).

As shown in FIG. 4A, rearward projection 125 has a breadth dimension (bp) measured perpendicular to the front plane and extending from the forward-most end of edge segments 125*a*, 125*b* to the rearward-most end of projection 125.

The breadth dimension ($b_p$) of rearward projection 125 may be related to a maximum breadth dimension ($b_f$) of forward sole region 120 and/or forward sole surface 121. Thus, for example, a maximum breadth dimension ($b_p$) of rearward projection 125 may range from approximately 10% to approximately 80% of the maximum breadth dimension ($b_f$) of forward sole region 120. This may be considered to be a relatively short projection. As another example, the maximum breadth dimension ($b_p$) of rearward projection 125 may range from approximately 60% to approximately 150%, from approximately 70% to approximately 150%, or even from approximately 80% to approximately 150% of the maximum breadth dimension ($b_f$) of forward sole region 120. This may be considered to be a medium long projection. Longer projections may have a maximum breadth dimension ($b_p$) that ranges from approximately 150% to approximately 180%, from approximately 150% to approximately 200%, or even greater than 200% of the maximum breadth dimension ($b_f$) of forward sole region 120.

According to certain embodiments, the breadth dimension ($b_p$) of rearward projection 125 may range from 5 mm to 50 mm, from 10 mm to 50 mm, from 20 mm to 50 mm, or even from 30 mm to 50 mm. Alternatively, rearward projection 125 may have a breadth dimension ($b_p$) of greater than 50 mm, greater than 60 mm, or even greater than 70 mm.

Rearward projection 125 may also have a length dimension ($l_p$) defined as the lengthwise (i.e., side-to-side) distance between the first projecting edge segment 125*a* and second projecting edge segment 125*b*. Further, the maximum length dimension ($l_p$) of rearward projection 125 may be related to the length dimension (L) of club head 14. Thus, for example, the maximum length dimension ($l_p$) of rearward projection 125 may range from approximately 10% to approximately 30% of the length dimension (L) of club head 14. This may be considered to be a relatively narrow projection. As another example, the maximum length dimension ($l_p$) of rearward projection 125 may range from approximately 20% to approximately 70%, from approximately 30% to approximately 60%, or even from approximately 30% to approximately 50% of the length dimension (L) of club head 14. This may be considered to be a medium width projection. Wider projections may have a maximum length dimension ($l_p$) that ranges from approximately 50% to approximately 75%, from approximately 50% to approximately 80%, or even from approximately 80% to approximately 90% of the length dimension (L) of club head 14.

According to certain embodiments, the length dimension ($l_p$) of rearward projection 125 may range from 20 mm to 70 mm, from 30 mm to 70 mm, from 40 mm to 70 mm, or even from 50 mm to 70 mm. Alternatively, rearward projection 125 may have a length dimension ($l_p$) of greater than 70 mm, greater than 80 mm, or even greater than 90 mm.

According to other embodiments, rearward projection 125 may be located in the middle 80% of the total length (L) of club head 14. In other words, in this particular embodiment, rearward projection 125 would not be located in the heel-side 10% or in the toe-side 10% of club head 14. In other embodiments, rearward projection 125 may be limited to the middle 50% of the total length (L) of the club head 14. In other words, according to this aspect, if the total length (L) of club head 14 is divided into four quadrants, rearward projection 125 does not lie in the quadrant closest to heel 24 nor does rearward projection 125 lie in the quadrant closest to toe 20.

According to some aspects and referring to FIGS. 2A-5, the bottom or sole 28 of club head 14 may be provided with a void, recess or cavity feature 300 generally located above (when the club is oriented in its standard address position) forward sole portion 120 and/or forward sole surface 121. Cavity feature 300 has a rearward facing opening located above the forward sole region 120 and below the rearward sole region 110. Cavity feature 300 may reduce the mass of the club head 14 and raise the center of gravity. As discussed above, for golfers with relatively slow swing speeds, raising the center of gravity may be advantageous.

Figure 5:
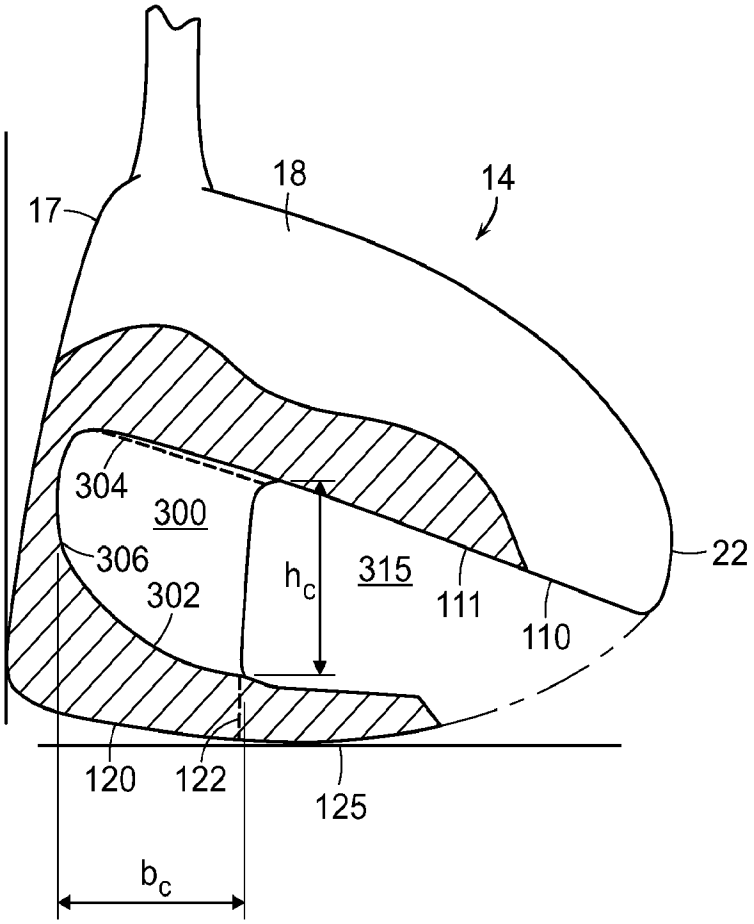
FIG. 5 is a heel-side view, with a partial cut-away cross-section, of the golf club of FIG. 4A.

Referring now to FIG. 5, cavity feature 300 includes a floor 302, a ceiling 304, and a front wall 306. Height and length dimensions of cavity feature are measured parallel to the front plane; breadth dimensions of cavity feature are measured perpendicular to the front plane. A height dimension ($h_c$) of cavity feature 300 may be measured from the floor 302 to the ceiling 304. Referring to back to FIG. 2A, a length dimension ($l_c$) of cavity feature 300 may be measured from a heel-side edge 300*a* to a toe-side edge 300*b* of cavity feature 300. The length dimension ($l_c$) of cavity feature 300 may vary along its breadth and along is height. One particularly relevant length dimension of cavity feature 300 may be the length dimension ($l_{cr}$) as measure at rearward edge 122 of forward sole region 120. Referring now to FIG. 5, a breadth dimension ($b_c$) of cavity feature 300 may be measured from the rearward edge 122 of forward sole region 120 to the front wall 306. The breadth dimension ($b_c$) of cavity feature 300 may vary along its length due to curvature in the front wall 306 and/or due to curvature in the rearward edge 122 of forward sole region 120.

When forward sole region 120 is provided with a rearward projection 125, the breadth dimension ($b_c$) of cavity feature 300 may be determined as if rearward projection 125 was not there. In other words, the breadth dimension ($b_c$) of cavity feature 300 may be determined as if rearward edge 122 virtually extends across where rearward projection 125 meets the remainder of forward sole region 120.

Thus, according to certain aspects, cavity feature 300 has a breadth dimension ($b_c$) that extends from the rearward edge 122 of forward sole region 120 to front wall 306. Breadth dimension ($b_c$) may extend all the way or substantially all the way from rearward edge 122 of forward sole region 120 to a back wall of ball striking surface 17. Optionally, cavity feature 300 may have a breadth dimension ($b_c$) that extends from rearward edge 122 a majority of the breadth dimension ($b_f$) of forward sole region 120. For example, cavity feature 300 may have a breadth dimension ($b_c$) that extends forward from rearward edge 122 up to 60%, 70%, 80%, 90%, or even up to 95% of the breadth dimension ($b_f$) of forward sole region 120. Alternatively, cavity feature 300 may have a somewhat shallow breadth dimension ($b_c$), i.e., a breadth dimension ($b_c$) that only extends forward from rearward edge 122 up to 10%, 20%, 30%, 40%, or even up to 50% of the breadth dimension ($b_f$) of forward sole region 120.

According to certain embodiments, the breadth dimension ($b_c$) of cavity feature 300 may be substantially constant along its length. In such case, a cross-section of the cavity, when viewed from above, would have a generally squared-off profile. Alternatively, the breadth dimension ($b_c$) of cavity feature 300 need not be constant along its length, i.e., it need not be constant as cavity feature 300 extends from the heel side of club head 14 to the toe side.

Figure 6B:
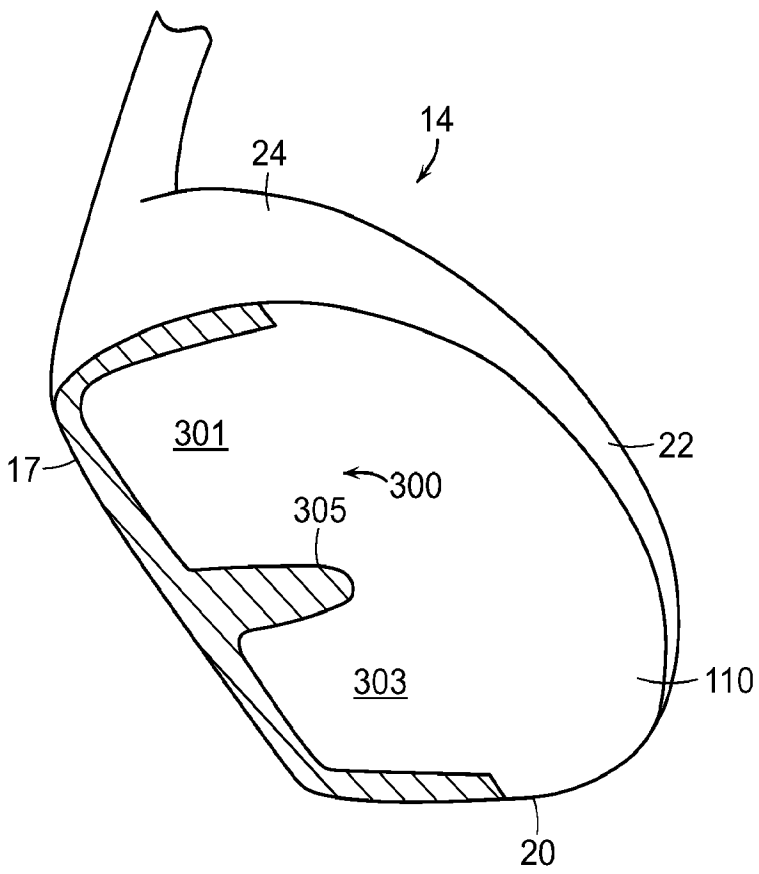
FIG. 6B is a perspective view, generally taken from a heel-side of the sole, with the forward sole region cut away to show a cross-section of the cavity feature of a golf club according to certain aspects.
Figure 6A:
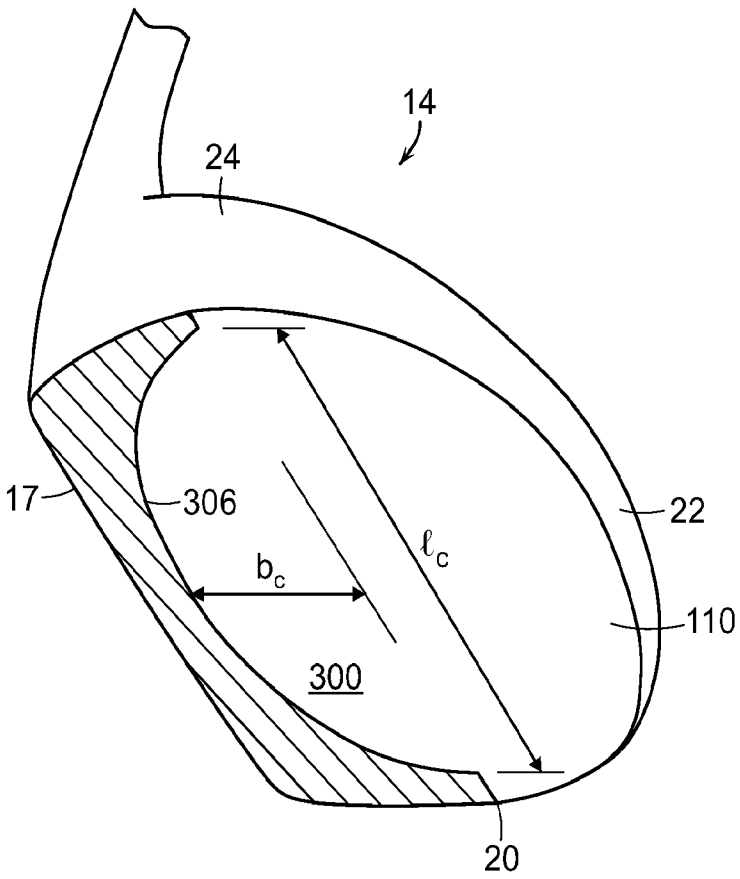
FIG. 6A is a perspective view, generally taken from a heel-side of the sole, with the forward sole region cut away to show a cross-section of the cavity feature of a golf club according to certain aspects.

For example, as shown in FIGS. 6A-6B, the breadth dimension ($b_c$) of cavity feature 300 may vary along its length. As shown in FIG. 6A, the breadth dimension ($b_c$) of cavity feature 300 may have a substantially C-shaped profile, when viewed from below. Alternatively, as shown in FIG. 6B, the breadth dimension ($b_c$) of cavity feature 300 may have a double-humped or recurved profile, when viewed from below. In other words, the cavity feature 300 may have a breadth dimension ($b_c$) that is reduced near the centerline of club head 14, such that cavity feature 300 is formed as two connected lobes 301, 303 separated by a peninsula 305. Even further, the breadth dimension ($b_c$) of cavity feature 300 may be reduced to zero near the centerline of club head 14, such that cavity feature 300 is formed as two completely separate lobes 301, 303 and peninsula 305 extends all the way (or substantially all the way) to rearward edge 122.

According to certain embodiments, the profile of cavity feature 300, when viewed from above, may be substantially symmetrical. Alternatively, the breadth dimension ($b_c$) of cavity feature 300 need not be symmetrical. For example, the breadth dimension ($b_c$) of cavity feature 300 may taper more toward the toe-side than toward the heel-side (or vice versa). Other example embodiments would be apparent to persons of ordinary skill in the art, given the benefit of this disclosure.

According to another aspect, cavity feature 300 may be approximately centered, side-to-side, within forward sole region 120. Alternatively, cavity feature 300 may be off center, i.e., shifted toward the heel or the toe-side of forward sole region 120. According to certain embodiments, cavity feature 300 extends across the centerline of club head 14.

Referring back to FIG. 5, cavity feature 300 may have a maximum breadth dimension ($b_c$) (measured from rearward edge 122 to front wall 306) of 10 mm or greater. Alternatively, cavity feature 300 may have a maximum breadth dimension ($b_c$) of 20 mm or greater, a maximum breadth dimension ($b_c$) of 30 mm or greater, or even a maximum breadth dimension ($b_c$) of 40 mm or greater.

Referring back to FIG. 6A, cavity feature 300 has a length dimension ($l_c$) that extends from a heel-side edge 300*a* of cavity feature 300 to a toe-side edge 300*b* of cavity feature 300. Length dimension ($l_c$) is measure at the opening of cavity feature 300, i.e., along the most rearward feature that defines cavity feature 300. According to some aspects, length dimension ($l_c$) may extend a majority of the way from the heel 24 of forward sole region 120 to the toe 20 of forward sole region 120. For example, cavity feature 300 may have a length dimension ($l_c$) that extends greater than 60%, 70%, 80%, 90%, or even greater than 95% of the rearward length dimension ($l_f r$) of forward sole region 120. Alternatively, cavity feature 300 may have a length dimension ($l_c$) that extends up to 10%, 20%, 30%, 40%, or even up to 50% of the rearward length dimension ($l_{fr}$) of forward sole region 120.

According to certain embodiments, cavity feature 300 may have a maximum length dimension ($l_c$) of 80 mm or greater. Alternatively, cavity feature 300 may have a maximum length dimension ($l_c$) of 90 mm or greater, a maximum length dimension ($l_c$) of 100 mm or greater, or even a maximum length dimension ($l_c$) of 100 mm or greater.

Even further, the length dimension ($l_c$) of cavity feature 300 may be constant along its breadth. Alternatively, the length dimension ($l_c$) of cavity feature 300 need not be constant along its breadth, i.e., it need not be constant as cavity feature 300 extends from the rearward edge 122 of forward sole region 120 toward the front of club head 14. For example, as shown in FIG. 6A, length dimension ($l_a$) of cavity feature 300 may vary along its breadth.

According to other aspects and referring back to FIG. 5, cavity feature 300 has a height dimension ($h_c$) that extends from floor 302 to ceiling 304. The height dimension ($h_c$) of cavity feature 300 may be constant or it may vary along the length and/or along the breadth of cavity feature 300. According to certain embodiments, cavity feature 300 may have a height dimension ($h_c$) that extends up to 60%, 70%, 80%, 90% or even up to 95% of the height dimension ($h_f$) of forward sole region 120. Alternatively, cavity feature 300 may have a height dimension ($h_c$) that extends up to 10%, 20%, 30%, 40%, or even up to 50% of the height dimension ($h_f$) of forward sole region 120.

Cavity feature 300 may have a maximum height dimension ($h_c$) of 10 mm or greater. Alternatively, cavity feature 300 may have a maximum height dimension ($h_c$) of 15 mm or greater, a maximum height dimension ($h_c$) of 20 mm or greater, or even a maximum height dimension ($h_c$) of 25 mm or greater.

According to certain aspects, the cavity feature 300 has a rearward facing opening extending upward from rearward edge 122. Generally, the opening may have a greater length dimension than a height dimension. According to certain embodiments, the rearward facing opening of cavity feature has a maximum length-to-maximum height ratio ranging from 1.0 to 5.0. According to other embodiments, the opening of cavity feature 300 may be relatively long and narrow, having a maximum length-to-maximum height ratio ranging from 4.0 to 7.0. Alternatively, the opening of cavity feature 300 may have a maximum length-to-maximum height ratio ranging from 2.0 to 6.0, from 3.0 to 6.0, or even from 3.0 to 5.

According to some aspects, the rearward facing opening of cavity feature 300 may have a maximum height dimension ($h_c$) that is less than or equal to 50% of the height (H) of the club head. Optionally, the height dimension ($h_c$) of the opening may be greater than or equal to 5% of the height (H) of club head 14 and less than or equal to 50% of the height (H). Alternatively, the height of the opening may range from 10% to 50% of the height (H), from 20% to 50% of the height (H), or even from 30% to 50% of the height (H). According to some embodiments, the height of the opening of the cavity feature 300 may be less than 40% of the height (H) of club head 14.

According to even other aspects, cavity feature 300 has a volume greater than $10.0_{cm^3}$, greater than 20.0 $cm^3$, greater than 30.0 $cm^3$, greater than 40.0 $cm^3$, greater than 50.0 $cm^3$ or even greater than 60.0 $cm^3$. For example, cavity feature 300 may have a volume ranging from 10.0 $cm^3$ to 90.0 $cm^3$ greater, from 20.0 $cm^3$ to 80.0 $cm^3$ greater, or even from 30.0 $cm^3$ to 70.0 $cm^3$ greater.

As best shown in FIG. 5, the surface 111 of rearward sole region 110 may smoothly merge with ceiling 304 of cavity feature 300. Optionally, there may be a noticeably change in elevation at the intersection of surface 111 of rearward sole region 110 with ceiling 304.

Still referring to FIG. 5, a volume or void 315 may be defined between rearward projection 125 and the surface 111 of rearward sole region 110. In other words, void 315 is defined by and lies above rearward projection 125. Void 315 would typically not be enclosed by heel-side or toe-side walls. Void 315 lies rearward of cavity feature 300.

Figure 7:
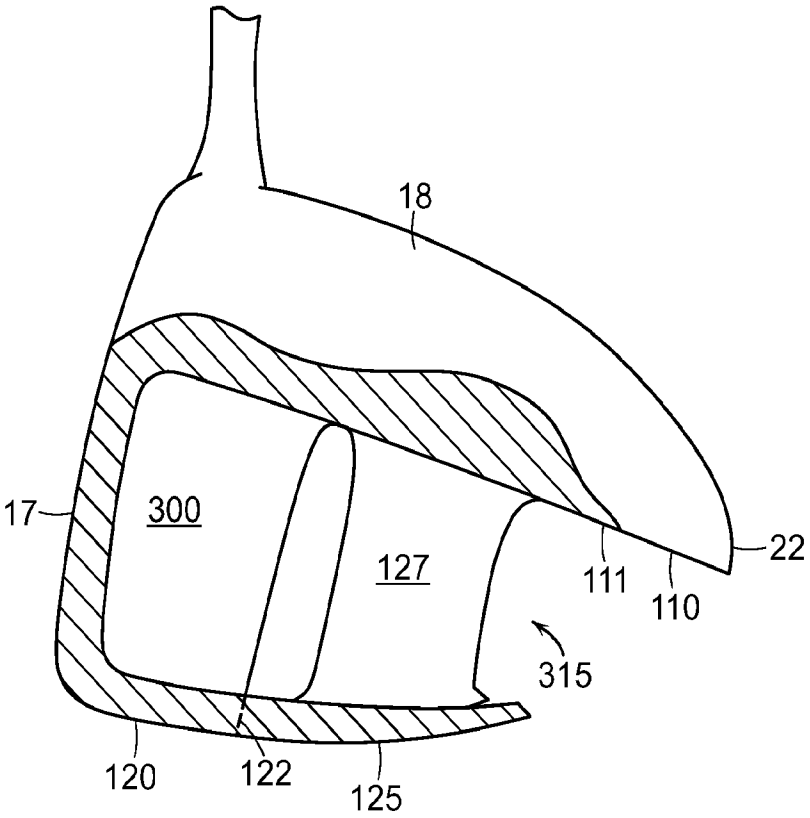
FIG. 7 is a heel-side view, with a partial cut-away cross-section, of a golf club according to certain aspects.

According to certain aspects, a support structure 127 may be provided in the volume or void 315 between the surface 111 of rearward sole region 110 and the rearward projection 125. According to some aspects, support structure 127 and void 315 may share the volume located between the surface 111 of rearward sole region 110 and the rearward projection 125. Thus, as shown in FIG. 7, support structure 127 may be formed as one or more discrete pedestals, columns or walls that extend from rearward sole region 110 to rearward projection 125. According to certain embodiments, support structure 127 may have substantially the same areal footprint, when viewed from below, as rearward projection 125. Alternatively, support structure 127 may have a significantly smaller footprint, such that portions of rearward projection 125 are unsupported. Support structure 27 may be freestanding (as shown in FIG. 7) or, according to even other aspects, it may be formed as an extension of peninsula 305.

Figure 8:
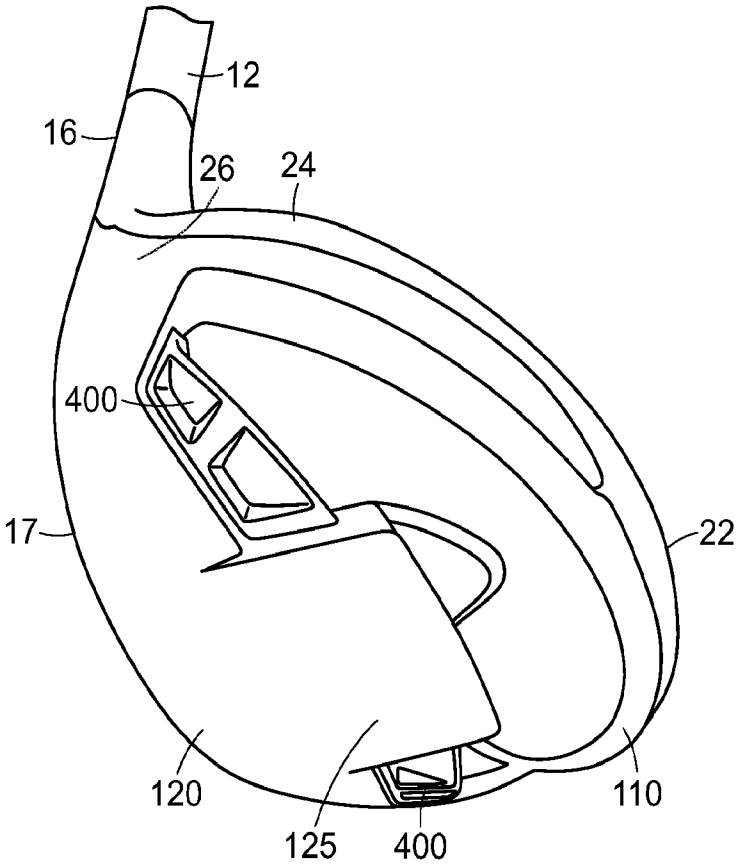
FIG. 8 is a perspective view, generally taken from a heel-side of the sole, of a golf club according to certain aspects.

According to certain aspects of the invention and referring now to FIG. 8, club head 14 may include a transition element 400 extending from rearward edge 122 of forward sole region 120. In general, transition element 400 spans or partially spans the volume between rearward projection 125, the rearward edge 122, and the heel- or toe-side walls of forward sole region 120.

As shown in FIG. 8, a pair of transition elements 400 may be positioned on either side of rearward projection 125. Transition element 400 extends from rearward edge 122 toward the rear 22 of club head 14. Further, transition element 400 may also extend upward toward the surface 111 of rearward sole region 110. In the particular embodiment of FIG. 8, transition element 400 is slightly upwardly offset from surface 121 of forward sole region 120. Even further, transition element 400 is upwardly offset from the surface of rearward projection 125. In other words, transition element 400 may have a downward facing surface that is upwardly offset in the height direction from a downward facing surface of projection 125.

Transition element 400 may serve to extend forward sole region 120, thereby possibly ameliorating aerodynamic effects that could be caused by abrupt discontinuities, while at the same time providing a reduced ground-contacting surface. Optionally, transition element 400 may serve to partially close off the opening of cavity feature 300, thereby possibly inhibiting or preventing debris from entering cavity feature 300.

Transition element 400 is not joined to the surface 111 of rearward sole region 110. Thus, cavity feature 300 remains an open cavity. Optionally, transition element 400 may cover approximately 20% to approximately 80% of the opening of cavity feature 300. According to certain embodiments, transition element 400 may cover up to 60%, 70%, 80%, or even up to 90% of the opening of cavity feature 300. Alternatively, transition wall 400 may cover only up to 10%, 20%, 30%, 40%, or even up to 50% of the opening cavity feature 300.

According to some embodiments, transition element 400 may extend alongside rearward projection 125 the full breadth dimension ($b_p$) of rearward projection 1254. Alternatively, transition element 400 may extend up to 60%, 70%, 80%, or even up to 90% of the breadth dimension ($b_p$) of rearward projection 125. Optionally, transition wall 400 may extend only up to 10%, 20%, 30%, 40%, or even up to 50% of the breadth dimension ($b_p$) of rearward projection 125.

According to certain aspects, transition element 400 may be formed separately from sole 28 and subsequently attached to club head 14. Optionally, transition element 400 is provided as an insert that can be permanently or non-permanently attached to forward sole region 120. In the embodiment shown in FIG. 8, each transition element 400 has a pair of generally trapezoidally-shaped, sloped recesses. As would be apparent to persons of ordinary skill in the art, given the benefits of this disclosure, transition element 400 may be provided with various configurations that allow it to span or partially span the gap between rearward projection 125, the rearward edge 122 and the heel- and/or toe-side walls of forward sole region 120.

According to certain aspects, the club head is a driver and the length and/or the breadth of the club head may be greater than 11.0 cm. For example, the club head breadth (B) may be greater than or equal to approximately 11.5 cm, or even greater than or equal to approximately 12.0 cm. Similarly, by way of one example, the club head length (L) may be greater than or equal to approximately 11.5 cm, or even greater than or equal to approximately 12.0 cm.

It is expected that a club head having reduced-profile feature 200 will provide a relatively streamlined club head with improved moment-of-inertia (MOI) characteristics. For example, it is expected that the moment-of-inertia (Izz) around a vertical axis associated with the club head's center-of-gravity may be greater than 3100 g-cm$^2$, greater than 3200 g-cm$^2$, or even greater than 3300 g-cm$^2$ for square-head type club heads. Further, it is expected that the moment-of-inertia (Ixx) around a horizontal axis associated with the club head's center-of-gravity may be greater than 5250 g-cm$^2$, greater than 5350 g-cm$^2$, or even greater than 5450 g-cm$^2$ for square-head type club heads. The vertical (z) axis and the horizontal (x) axis are defined with the club head in the 60° lie angle position (see FIGS. 1A and 1B).

Additionally, it is expected that reduced-profile feature 200 may result in the height of the center of gravity (CG) of club head 14 being less than or equal to approximately 2.0 cm, less than or equal to approximately 1.75 cm, or even less than or equal to approximately 1.5 cm.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

The invention claimed is:

1. A golf club head comprising:

a ball striking face, a heel, a toe, a rear, a crown and a sole, the club head having a top-to-bottom height, a front-to-back breadth and a side-to-side length;

the sole including:

a substantially horizontally-oriented forward sole surface extending rearwardly from the ball striking face to a rearward edge;

a substantially horizontally-oriented rearward sole surface extending forwardly along a centerline of the club head from the rear of the club head, the rearward sole surface offset from the rearward edge in a height direction;

a projection extending rearwardly from the rearward edge of the forward sole surface; and a support structure, the support structure separating a first portion of the rearward sole surface from a second portion of the rearward sole surface;

wherein the support structure comprises a first area footprint when viewed from an address position;

wherein the projection comprises a second area footprint when viewed from the address position; and wherein the first area footprint of the support structure is smaller than the second area footprint of the projection such that portions of the projection are unsupported.

2. The golf club head of claim 1, wherein the support structure comprises a column that extends from the substantially horizontally-oriented rearward sole surface to the substantially horizontally-oriented forward sole surface.

3. The golf club head of claim 1, wherein the support structure comprises a wall that extends from the substantially horizontally-oriented rearward sole surface to the substantially horizontally-oriented forward sole surface.

4. The golf club head of claim 1, wherein the rearward sole surface is offset from forward sole surface in the height direction by at least 10 mm at the centerline of the club.

5. The golf club head of claim 1, wherein the forward sole surface has a heel-side breadth dimension and a toe-side breadth dimension of at least 20 mm.

6. The golf club head of claim 1, wherein the substantially horizontally-oriented forward sole surface has a maximum breadth dimension that is greater than or equal to 25% of the breadth of the club head.

7. The golf club head of claim 1, wherein the rearward sole surface is substantially planar.

8. The golf club head of claim 1, wherein a rearward end of the projection is located in the most rearward 25% of the breadth of the club head.

9. The golf club head of claim 1, wherein a maximum breadth dimension of the projection ranges from 10 mm to 60 mm.

10. The golf club head of claim 1, wherein the projection has a maximum breadth dimensions that ranges from approximately 60% to approximately 150% of the maximum breadth dimension of the forward sole surface.

11. A golf club head comprising:

a ball striking face, a heel, a toe, a rear, a crown and a sole, the club head having a top-to-bottom height, a front-to-back breadth and a side-to-side length;

the sole including:

a substantially horizontally-oriented forward sole surface extending rearwardly from the ball striking face to a rearward edge;

a substantially horizontally-oriented rearward sole surface extending forwardly along a centerline of the club head from the rear of the club head, the rearward sole surface offset from the rearward edge in a height direction;

a projection extending rearwardly from the rearward edge of the forward sole surface; and a support structure, the support structure separating a first portion of the rearward sole surface from a second portion of the rearward sole surface;

wherein the support structure comprises a first area footprint when viewed from an address position;

wherein the projection comprises a second area footprint when viewed from the address position;

wherein the first area footprint of the support structure is smaller than the second area footprint of the projection such that portions of the projection are unsupported; and wherein the forward sole surface extends less than 50% of the front-to-back breadth.

12. The golf club head of claim 11, wherein the support structure comprises a column that extends from the substantially horizontally-oriented rearward sole surface to the substantially horizontally-oriented forward sole surface.

13. The golf club head of claim 11, wherein the support structure comprises a wall that extends from the substantially horizontally-oriented rearward sole surface to the substantially horizontally-oriented forward sole surface.

14. The golf club head of claim 11, wherein the rearward sole surface is offset from forward sole surface in the height direction by at least 10 mm at the centerline of the club.

15. The golf club head of claim 11, wherein the forward sole surface has a heel-side breadth dimension and a toe-side breadth dimension of at least 20 mm.

16. The golf club head of claim 11, wherein the substantially horizontally-oriented forward sole surface has a maximum breadth dimension that is greater than or equal to 25% of the breadth of the club head.

17. The golf club head of claim 11, wherein the rearward sole surface is substantially planar.

18. The golf club head of claim 11, wherein a rearward end of the projection is located in the most rearward 25% of the breadth of the club head.

19. The golf club head of claim 11, wherein a maximum breadth dimension of the projection ranges from 10 mm to 60 mm.

20. The golf club head of claim 11, wherein the projection has a maximum breadth dimensions that ranges from approximately 60% to approximately 150% of the maximum breadth dimension of the forward sole surface.

* * * * *